US005178694A

United States Patent [19]

Wu et al.

[11] Patent Number: 5,178,694

[45] Date of Patent: Jan. 12, 1993

[54] SURFACE HARDENING OF TI-6AL-4V BY ELECTROLYTIC HYDROGENATION

[75] Inventors: Jiann-Kuo Wu, Taipei; Tair-I Wu, Yi-Lan, both of Taiwan

[73] Assignee: National Science Council, Taipei, Taiwan

[21] Appl. No.: 818,103

[22] Filed: Jan. 8, 1992

[51] Int. Cl.[5] ..... C22C 22/00

[52] U.S. Cl. ..... 148/669; 148/670; 148/671; 205/322; 420/900; 429/101

[58] Field of Search ..... 148/669, 670, 671; 420/900; 205/322; 429/101

[56] References Cited

U.S. PATENT DOCUMENTS 3,840,442 10/1974 Chevalier et al. ..... 205/322
4,728,586 3/1988 Venkatesan et al. ..... 420/900
4,820,360 4/1989 Eylon et al. ..... 148/669
4,851,055 7/1989 Eylon et al. ..... 148/669
4,872,927 10/1989 Eylon et al. ..... 148/669

FOREIGN PATENT DOCUMENTS 3085001 4/1988 Japan ..... 420/900

*Primary Examiner*—Upendra Roy
*Attorney, Agent, or Firm*—Ladas & Parry

[57] ABSTRACT

Disclosed is a process of surface hardening of Ti-6A1-4V alloy that can be performed by electrolytic charging in an acid solution, subsequent solution treatment, followed by dehydrogenation to obtain an equiaxed alpha grain in transformed beta matrix. Surface hardnesses of the processed specimens are better than that of the mill-annealed specimen. The depth of hardened layer depends on the charging time.

5 Claims, 7 Drawing Sheets

SURFACE HARDENING OF TI-6AL-4V BY ELECTROLYTIC HYDROGENATION

FIELD OF THE INVENTION

The present invention relates to a surface hardening process for Ti-6Al-4V alloy which can be performed by electrochemical charging, subsequent solution treatment, followed by dehydrogenation to obtain an equiaxed $\alpha$ grain in transformed $\beta$ matrix.

DESCRIPTION OF RELATED ART

Thermochemical processing is an advanced method of enhancing the fabricability and mechanical properties of titanium alloys (F. H. Froes, D. Eylon, and C. Suryanarayana, Journal of Metals, Vol. 42, No. 3, pp. 26–29, 1990). In this process, hydrogen is added to the titanium alloy as a temporary alloying element. Hydrogen addition lowers the $\beta$ transus temperature of titanium alloy and stabilizes the $\beta$ phase. The increased amount of $\beta$ phase in hydrogen-modified titanium alloys reduces the grain growth rate during eutectoind $\beta \rightarrow \alpha$ = hydride reaction. In previous studies, hydrogen has been added to the titanium alloy by holding it at a relatively high temperature in a hydrogen gaseous environment (I. Grimberg, L. Levin, O. Botstein and F. H. Froes, J. Materials Research, Vol. 6, No. 10, pp. 2069–2076, 1991; L. L. Midolo and E. F. Moore, Journal of Metals, Vol. 43, No. 10, pp. 55–57, 1991). The hydrogen must be removed to a low allowable concentration in a vacuum system after the hydrogenation process. The present invention utilizes an electrochemical technique to dissolve hydrogen into titanium alloy to replace the hydrogen environment in thermochemical processing.

SUMMARY OF THE INVENTION

It is therefore an object of the present invention to provide a process for surface hardening of titanium alloys.

Another object of the present invention is to provide a process for grain refinement of titanium alloys.

The final object of the present invention is to provide a process for economically enhancing the fabricability and mechanical properties of titanium alloys.

The present invention for surface hardening a titanium alloy generally includes the following steps: cathodically charging the titanium alloy in an acid solution, heating the titanium alloy to a temperature range of 500° C. to 650° C., solution treating the titanium alloy in an air furnace, furnace cooling the titanium alloy to room temperature, removing the scale of the titanium alloy, dehydrogenating the titanium alloy in a vacuum furnace at 700° C. to 900° C., and furnace cooling the titanium alloy to room temperature.

The further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

Figure 1:
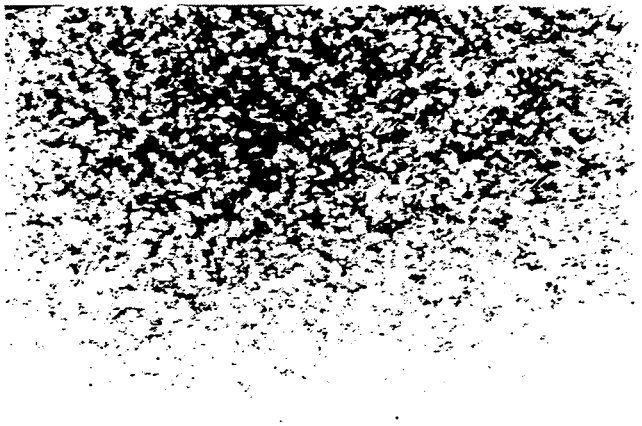
FIG. 1 shows the transverse section of the microstructure of a mill-annealed alloy.
Figure 2:
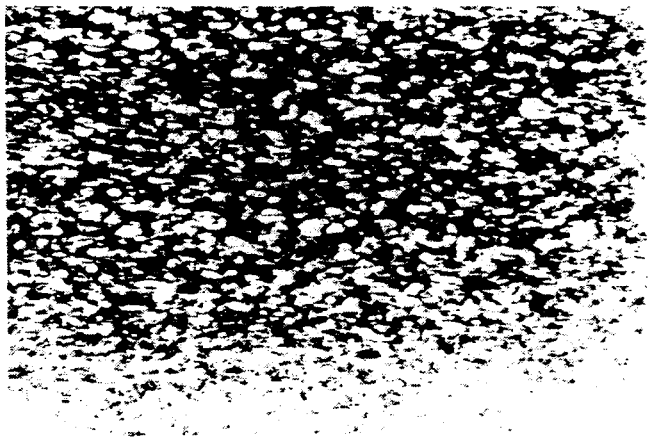
FIG. 2 shows the longitudinal section of the microstructure of a mill-annealed alloy.
Figure 3:
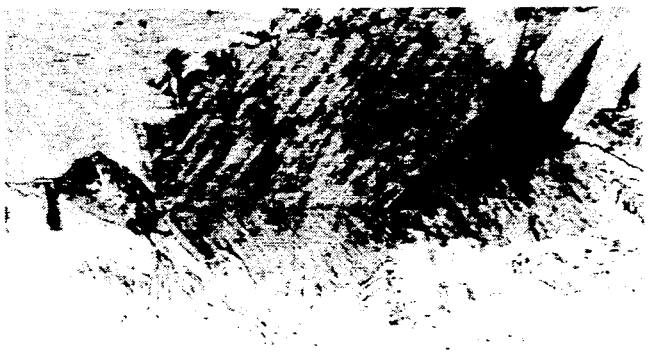
FIG. 3 shows the surface microstructure of the $\beta$-solution treated alloy.
Figure 4:
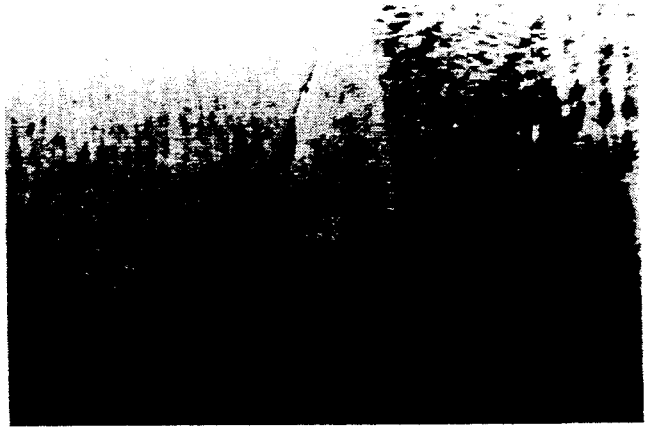
FIG. 4 shows the cross sectional microstructure of the $\beta$-solution treated alloy.
Figure 5:
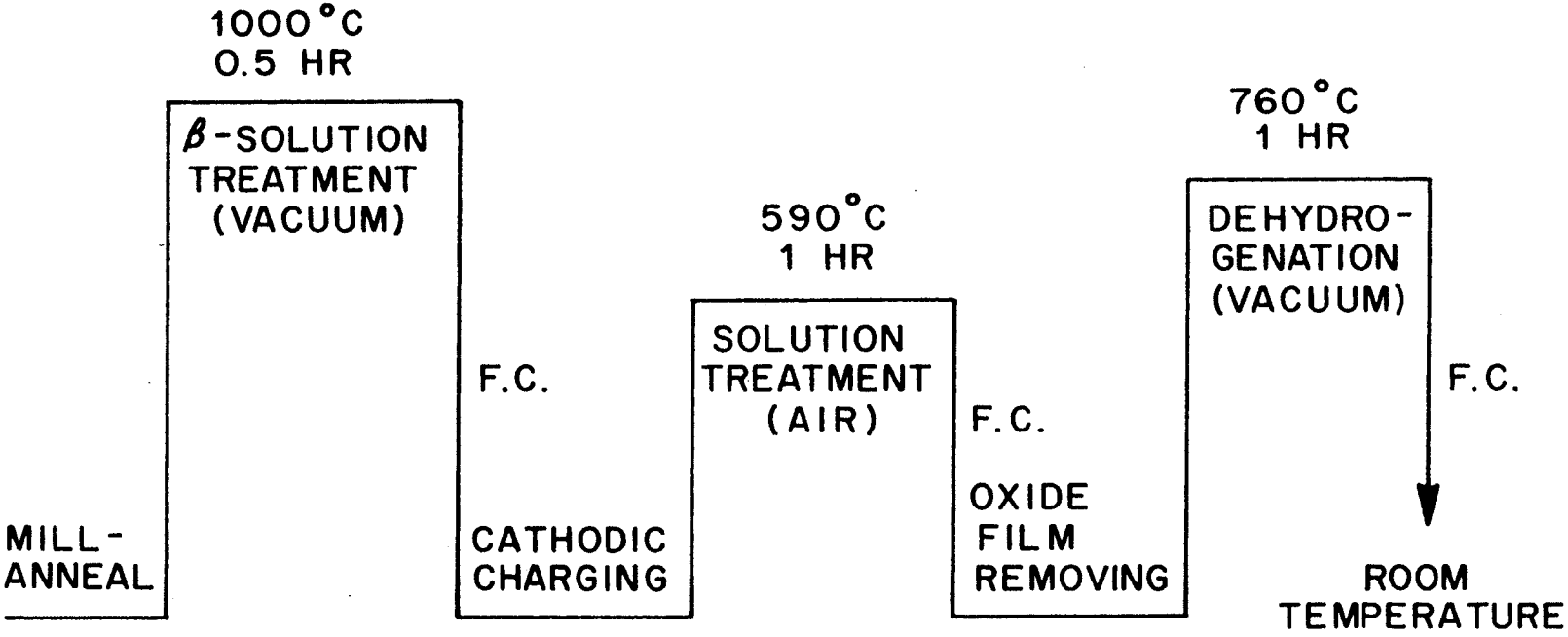
FIG. 5 is a schematic diagram of the thermochemical process according to the present invention.
Figure 6:
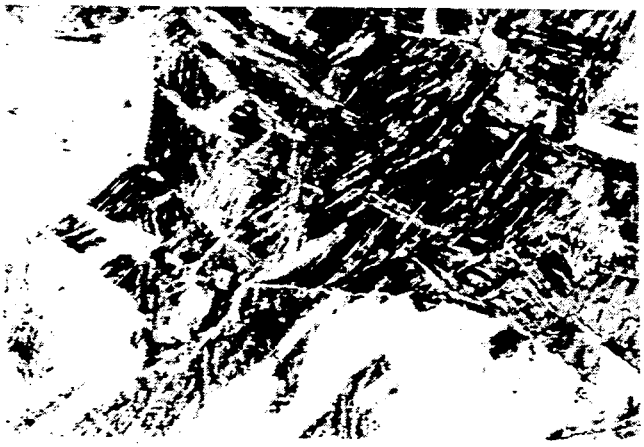
FIG. 6 shows the surface microstructure of the blank test specimen.
Figure 7:
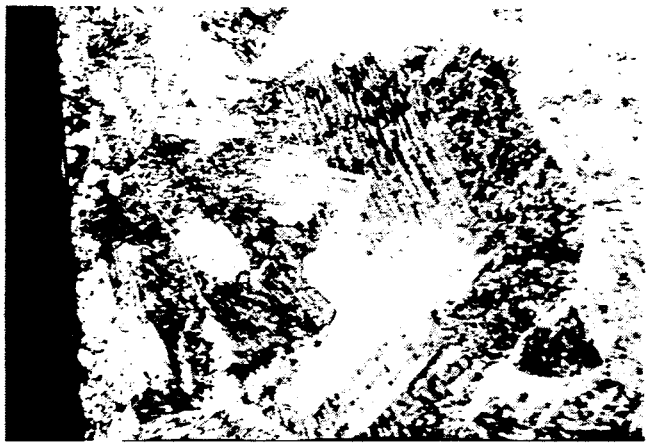
FIG. 7 shows the cross sectional microstructure of the blank test specimen.

The present invention will be described by the following experiment:

A mill-annealed Ti-6Al-4V alloy was used, and its composition is listed in Table I.

TABLE I

| Chemical composition of the mill-annealed alloy (wt %) | | | | | | | |
|---|---|---|---|---|---|---|---|
| Al | V | C | Fe | O | N | H | Ti |
| 6.48 | 4.27 | 0.44 | .0204 | .16 | .012 | .0079 | balance |

Samples were cut from a round bar stock after $\beta$-solution treated at 1000° C. for 0.5 hour in a vacuum of $2\times10^{-10}$ MPa and furnace cooled to obtain the transformed $\beta$ microstructures, then machined to 5 mm thickness. The specimens were then ground with grinding paper down to 1000 grit. The purposes of B-solution treatment are two-fold: first, to coarsen the initial grain size of the material to see the effect of grain refinement by electrochemical hydrogenation; second, to obtain the transformed $\beta$ microstructures to increase the total amount of hydrogen absorption in this alloy. Optical micrographs are shown in FIGS. 1 to 4. Specimens were hydrogenated by an electrochemical technique. The hydrogen was cathodically charged in 1N $H_2SO_4$ solution. A Luggin probe with a saturated calomel electrode was inserted in the electrolyte. Platinum served as an anode. For the hydrogenation, a specimen was charged with a constant current density (50 mA/cm$^2$) at room temperature for 12, 24, 36, 48 and 60 hours respectively; then it was removed from the electrolyte, rinsed with distilled water and acetone, and dried with pressurized air. The specimen was then immediately solution treated at 590° C. for 1 hour in air in order to produce an oxide film to impede hydrogen escape from the specimen, followed by furnace cooling. After the heat treatment was completed, the oxide film was removed by $H_2O_2$+HF (1:1) etchant. The specimen was then heated in a tubular furnace in an argon atmosphere to 760° C. The furnace was then pumped down to a $2\times10^{-10}$ MPa and the temperature was held at 760° C. for 2 hours. Then the power was turned off, while the vacuum system was kept running during the furnace cooling process.

The microhardness tests were conducted with a Model METEK No. AK-8 Vickers microhardness tester under a load of 400 g for 120 seconds.

Figure 8:
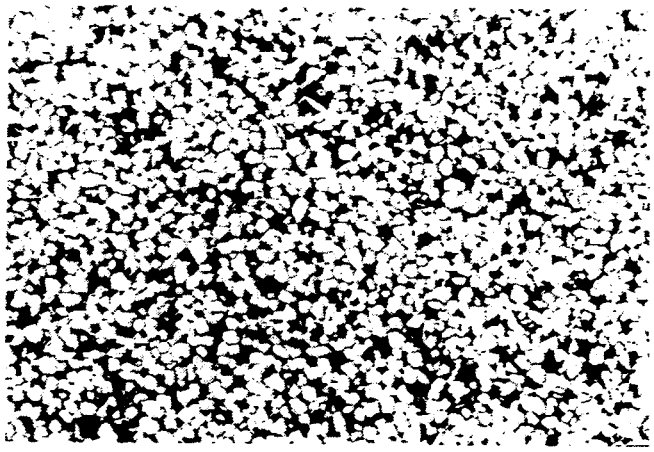
FIG. 8 shows the typical surface microstructure of the thermochemically treated alloy.
Figure 9:
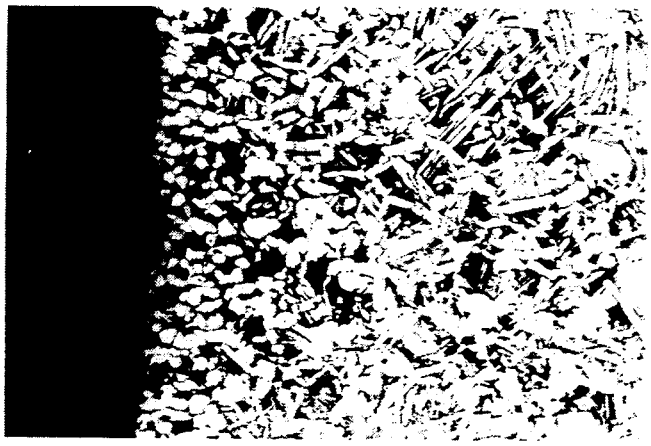
FIGS. 9 to 13 shows the cross sectional microstructures of the thermochemically treated alloys. The alloys have been cathodically charged for 12, 24, 36, 48 and 60 hours respectively.
Figure 10:
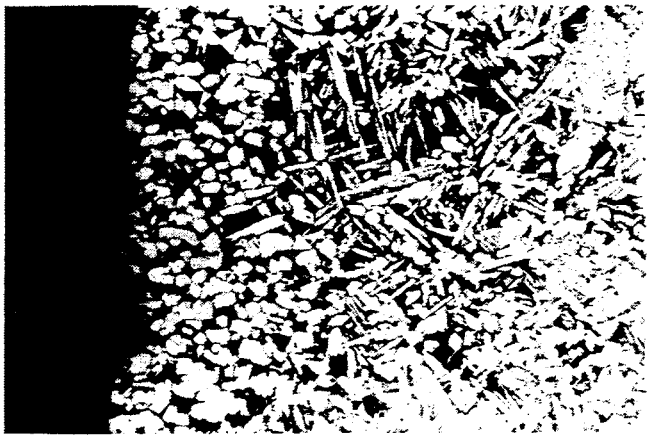
Figure 11:
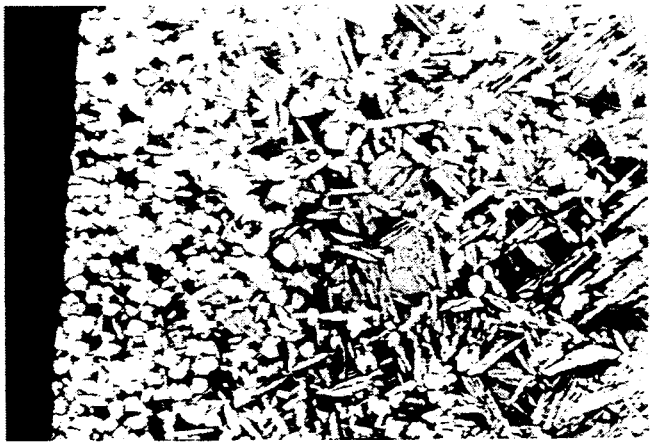
Figure 12:
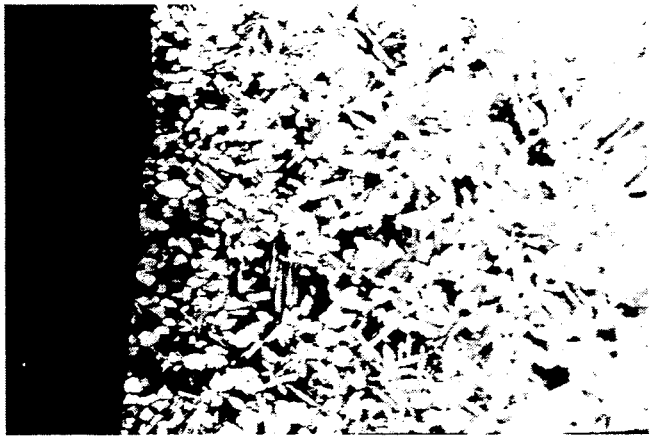
Figure 13:
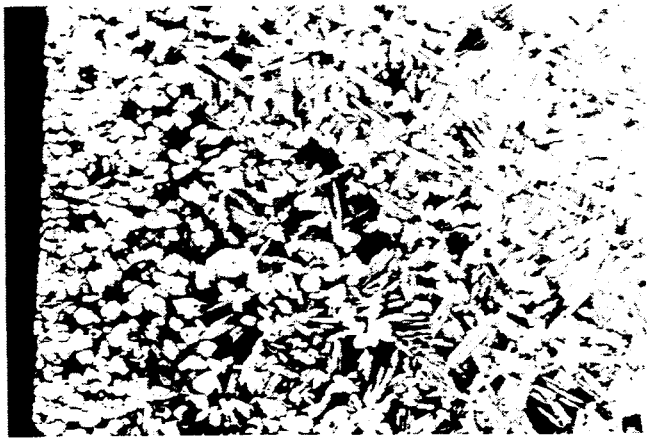

FIG. 8 shows the typical surface microstructure of the processed specimen after 12 hours of cathodic charging. Equiaxed $\alpha$ grain (light) in a transformed $\beta$ matrix (dark) with a grain size of 10–30 $\mu$m was found. FIGS. 9 to 13 show the cross sections of the microstructure after five different cathodic charging times. Equiaxed $\alpha$ grain layer is also observed near the surface. Partial equiaxed $\alpha$ grain containing mostly coarse acicular $\alpha$ is shown in the core of the specimens. The hardnesses of the processed specimens are listed in Table II.

TABLE II

Hardness and depth of refinement for various treatment

| treatment | hardness (HV) grain refined layer | core | surface | depth of grain refinement ($\mu$m) |
|---|---|---|---|---|
| mill-annealed | — | 330 | 325 | — |
| $\beta$-solution | — | 305 | 305 | — |
| blank test | — | 285 | 250 | — |
| charging time (hrs) | | | | |
| 12 | 340 | 290 | 340 | 100 |
| 24 | 340 | 290 | 340 | 150 |
| 16 | 340 | 320 | 340 | 230 |
| 48 | 340 | 320 | 340 | 230 |
| 60 | 340 | 320 | 340 | 230 |

The processed specimens show improvement of hardness near the specimens' surface. Table II shows no hardness differences at the surface as a function of hydrogenation time and a very minute change in the core between 12 or 24 hours and 36, 48 or 60 hours. This observation must be related to the diffusivity and solubility of hydrogen in Ti-6Al-4V alloy. The depth of the hardened surface layer depends on the charging current density and charging time. Surface hardnesses of the processed specimens is better than that of the mill-annealed material. It is known that the hardness of the $\alpha$ phase is greater than that of the $\beta$ phase. The strength of $\alpha+\beta$ titanium alloys increases as the volume fraction of the $\alpha$ phase increases. The hydrogen is removed by a vacuum heat treatment and a recrystallization process is associated, resulting in a hardened fine equiaxed o phase.

While the invention has been described by way of an example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A process for surface hardening a titanium alloy, comprising:

(a) cathodically charging the titanium alloy in an acid solution;

(b) heating the titanium alloy to a temperature range of 500° C. to 650° C.;

(c) solution treating the titanium alloy in an air furnace for producing an oxide film on the titanium alloy;

(d) furnace cooling the titanium alloy to room temperature;

(e) removing the oxide film of the titanium alloy;

(f) dehydrogenating the titanium alloy in a vacuum furnace at 700° C. to 900° C.;

(g) furnace cooling the titanium alloy to room temperature.

2. A process for surface hardening a titanium alloy as claimed in claim 1, wherein the titanium alloy is cathodically charged with a current density of about 50 mA/cm$^2$ at said step (a).

3. A process for surface hardening a titanium alloy as claimed in claim 1, wherein the titanium alloy is solution treated for 1 to 4 hours at said step (c).

4. A process for surface hardening a titanium alloy as claimed in claim 1, wherein the scale of the titanium alloy is removed in a solution of $H_2O_2+HF$ at said step (e).

5. A process for surface hardening a titanium alloy as claimed in claim 1, wherein the titanium alloy is dehydrogenated for 1 to 4 hours at said step (f).

* * * * *